US008854169B2

(12) United States Patent
Frontczak

(10) Patent No.: US 8,854,169 B2
(45) Date of Patent: Oct. 7, 2014

(54) AUTOMOTIVE IGNITION COIL HAVING A CORE WITH AT LEAST ONE EMBEDDED PERMANENT MAGNET

(75) Inventor: Charles R. Frontczak, Rockford, IL (US)

(73) Assignee: Tempel Steel Company, Chicago, IL (US)

( * ) Notice: Subject to any disclaimer, the term of this patent is extended or adjusted under 35 U.S.C. 154(b) by 36 days.

(21) Appl. No.: 13/617,471

(22) Filed: Sep. 14, 2012

(65) Prior Publication Data

US 2014/0080077 A1 Mar. 20, 2014

(51) Int. Cl.

| | |
|---|---|
| ***H01F 17/04*** | (2006.01) |
| ***H01F 27/02*** | (2006.01) |
| ***H01F 38/12*** | (2006.01) |

(52) U.S. Cl.

USPC ..... 336/122; 336/90; 123/634

(58) Field of Classification Search

CPC ..... H01F 7/14; H01F 38/12; H01F 2038/122; H01F 2038/127; F02P 3/02; H02K 15/024; H02K 15/03; H02K 2201/06; H02K 1/276

USPC ..... 336/90, 110, 155, 156, 221, 213; 123/634; 29/602.1; 335/229

See application file for complete search history.

(56) References Cited

U.S. PATENT DOCUMENTS

| | | | | |
|---|---|---|---|---|
| 4,990,881 | A * | 2/1991 | Ooyabu | 336/110 |
| 5,241,941 | A | 9/1993 | Hancock et al. | |
| 5,685,065 | A * | 11/1997 | Suzuki et al. | 29/606 |
| 6,853,285 | B2 * | 2/2005 | Kondo | 336/110 |
| 7,190,249 | B2 * | 3/2007 | Maekawa et al. | 336/92 |
| 7,202,767 | B2 * | 4/2007 | Maekawa et al. | 336/110 |
| 7,212,092 | B2 * | 5/2007 | Nuebel et | 336/83 |
| 8,289,117 | B2 * | 10/2012 | Dal Re et al. | 336/110 |

OTHER PUBLICATIONS

Dr. M.A. Rahman, "Advances on IPM Technology for Hybrid Cars and Impact in Developing Countries", 5th Intl. Conference on Electrical and Computer Engineering ICECE 2008, Dec. 20-22, 2008, Dhaka, Bangladesh.

Evaluation of the 2007 Toyota Camry Hybrid Synergy Drive System, Prepared by Oak Ridge National Laboratory Mitch Olszewski, Program Manager, U.S. Department of Energy FreedomCAR and Vehicle Technologies, EE-2G, Apr. 2008, pp. 46-48.

* cited by examiner

*Primary Examiner* — Alexander Talpalatski
*Assistant Examiner* — Joselito Baisa
(74) *Attorney, Agent, or Firm* — Schiff Hardin LLP

(57) ABSTRACT

In a spark plug ignition assembly for a spark plug, an ignition coil assembly has a steel laminated core, said core having a first core portion and a second core portion, and a primary winding around the first core portion and a secondary winding around the primary winding. A spark plug connecting member is provided for connecting the coil assembly to the spark plug. At least one of the first and second core portions has a slot therein with a magnet located in the slot.

9 Claims, 7 Drawing Sheets

AUTOMOTIVE IGNITION COIL HAVING A CORE WITH AT LEAST ONE EMBEDDED PERMANENT MAGNET

BACKGROUND

The present disclosure relates to an ignition coil assembly for ignition of a spark plug, such as in an automobile. A known ignition assembly 10 for ignition of an automobile spark plug 11 is shown in prior art FIG. 1. The assembly 10 connects to the spark plug 11 via a boot 12 connected with an ignition coil assembly 13 having a steel laminated core 14 and a molded plastic cover 15. The molded plastic cover 15 also houses a connector/electrical harness 16 at one side of the coil assembly 13.

As shown in prior art FIG. 2 with a portion of the cover 15 removed, a primary coil 17 is surrounded by a secondary coil 18 around what is known as an I core portion 19 adjacent ends of a C core portion 20 forming core 14. The I core portion 19 and the C core portion 20 are each formed of a stack of individual electrical steel laminations 19A and 20A, respectively.

A magnet 21 is inserted between one leg of the C core portion 20 and a side adjacent one end of the I core portion 19.

The laminations comprise electrical steel and the primary and secondary coils comprise copper magnet wire. An automotive battery provides a nominal 12 volt DC supply to the primary coil 17 as an inner winding around the I coil portion 19. The number of copper turns are on the order of a few hundred for the primary coil, whereas the surrounding secondary coil 18 has several thousand turns of magnet wire. A diameter of the primary coil wire is larger as compared to a diameter of the secondary coil wire. Both primary and secondary coils are connected in series.

The coil assembly 13 of the overall ignition assembly 10 works together with a number of other components that make up the ignition system. The modern day system utilizes sensors placed around the engine in order to provide signals to the ECM (Electronic Control Module—also known as the computer). The ECM then determines where the engine crank and camshafts are in mechanical degrees. When the timing is right, the voltage is sent to the ignition primary coil which will then be transferred to the secondary coil. This high voltage is sent to the individual spark plug at the moment the engine piston is at the top of the stroke. The fuel and air mixture is then burned and the piston is forced downward. This downward stroke partially rotates the crankshaft which supplies power to the transmission. The transmission then converts this power to torque which is delivered to the wheels for mobility. This action repeats for every ignition coil and piston in the engine in timed intervals. The faster the automobile drives, the faster the ignition process.

When a switch is closed, current will build easily in the primary coil 17 because it has less inductance than the secondary coil 18. Because the primary coil current is direct current, it creates a very small magnetic field with a constant magnitude which causes a minimal magnetic flux to flow in the steel laminations 19A and 20A. When the switch is opened, the current potential across the primary coil 17 collapses and dumps its energy into the secondary coil 18 which creates a much higher potential due to the many more turns of copper. Therefore this change of energy will add much more magnetic flux in the laminations. This exchange of energy happens within a few milliseconds. As the boost of current from the primary coil 17 decays down to zero, the magnetic flux completes a magnetic circuit loop and causes a large voltage potential across the secondary coil 18. This secondary coil voltage potential is typically in a range between 40,000 to 70,000 volts depending upon the type of engine it was designed for. It also maintains the maximum amount of voltage potential transfer. This high potential then has the ability to jump across a gap 11A of the spark plug 11 in order to ignite a fuel and air mixture in the cylinder at top dead center forcing the piston downward and thus causing a stroke which will help rotate the crankshaft of the internal combustion engine.

Design criteria requirements for an ignition coil are:

(1) Maximum transfer of energy without excess losses in the laminations. This is because losses are wasted energy and are converted to heat. Efficiency is reduced and the useable life of the product is compromised.

(2) Minimum decay time for transfer of energy. This is necessary for two reasons. First, the quicker the transfer of energy, the lower the losses on all the components. Secondly, tighter EPA (Environmental Protection Agency) emission regulations require recirculating the unburned gas mixture known as hydro carbons. These hydro carbons are not as easy to ignite as the pure fuel in the initial burn. Therefore the spark across the spark plug gap must have the highest potential.

Modern automobile ignition systems have advanced from the early days of one single ignition coil and distributor assembly for all cylinders to individual ignition coils, having one per cylinder, such as the single coil assembly 13 shown in FIG. 1. Different core geometric designs have been used such as the C core portion 20 and the I core portion 19 shown in FIG. 2, and C core portion 7 and T core portion 22 as shown in prior art FIG. 4 also having primary and secondary coils 8 and 9 respectively. However, whether it is C and I or C and T core portions, the function remains the same. The basic building blocks are also the same including the introduction of a permanent magnet 21 shown in FIG. 2 and also shown in the cross sectional view of FIG. 3. In the C and T arrangement the permanent magnet 23 is disposed between a T end of the T core portion 22 and a side of one leg of the C core portion 7. An example of the prior art magnet used in a C and T core portions is U.S. Pat. No. 5,241,941.

The advantage of the magnet 21 in FIG. 3 or the magnet 23 in FIG. 4 is a magnetic flux source within the steel core magnetic circuit. The permanent magnet flux opposes the previously described weak flux generated from the primary coil 17 when the switch is closed. This is to ensure that no voltage is generated on the secondary coil 18 until the switch is opened. At this moment the maximum voltage transfer is made.

SUMMARY

It is an object to improve upon the performance of ignition coils and improve the operational efficiency thereof.

In a spark plug ignition assembly for a spark plug, an ignition coil assembly has a steel laminated core, said core having a first core portion and a second core portion, and a primary winding around the first core portion and a secondary winding around the primary winding. A spark plug connecting member is provided for connecting the coil assembly to the spark plug. At least one of the first and second core portions has a slot therein with a magnet located in the slot.

DESCRIPTION OF PREFERRED EXEMPLARY EMBODIMENTS

Figure 1:
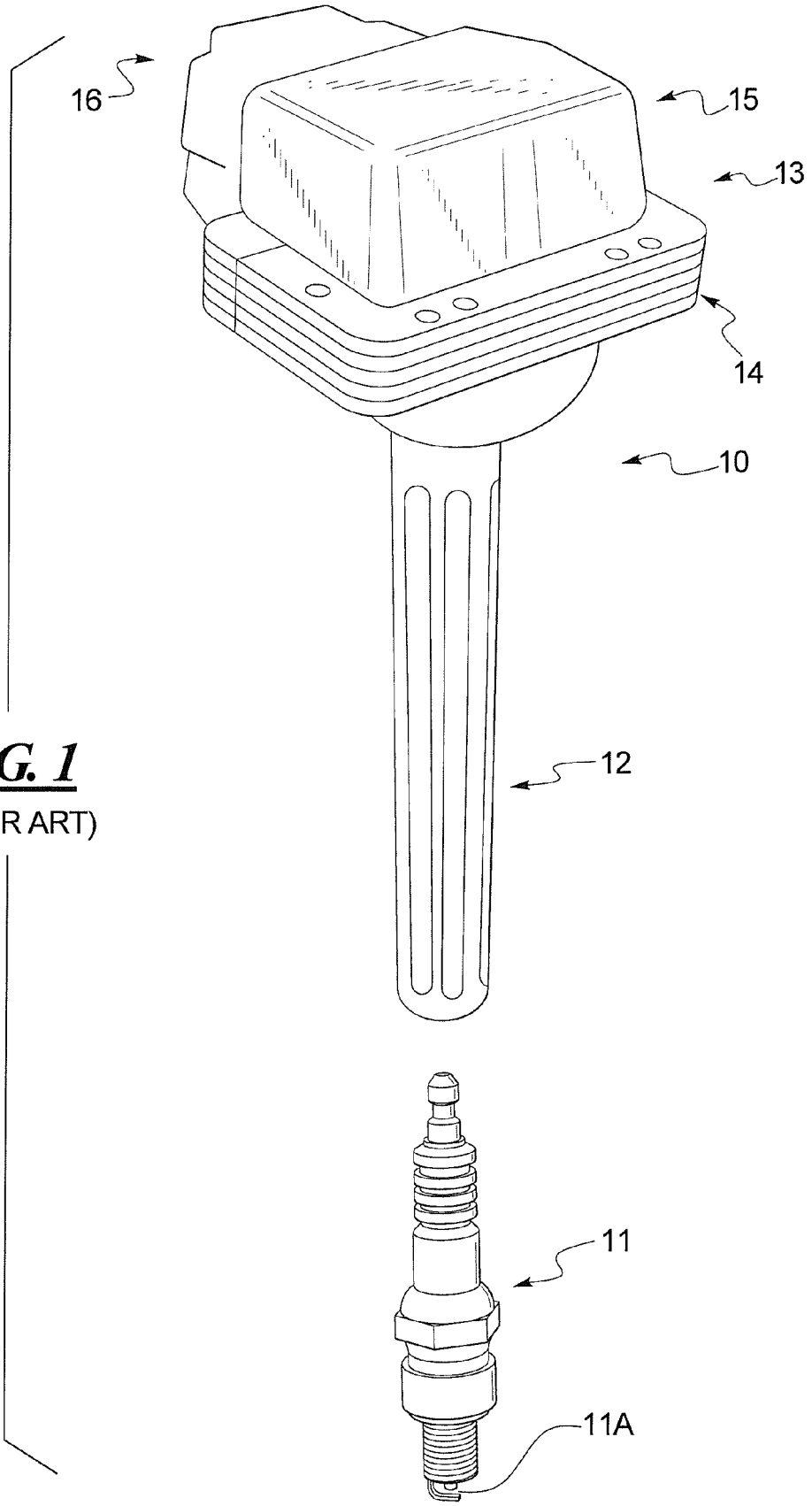
FIG. 1 (PRIOR ART)
FIG. 1 is a perspective view of a prior art automotive ignition assembly for spark plug ignition.
Figure 2:
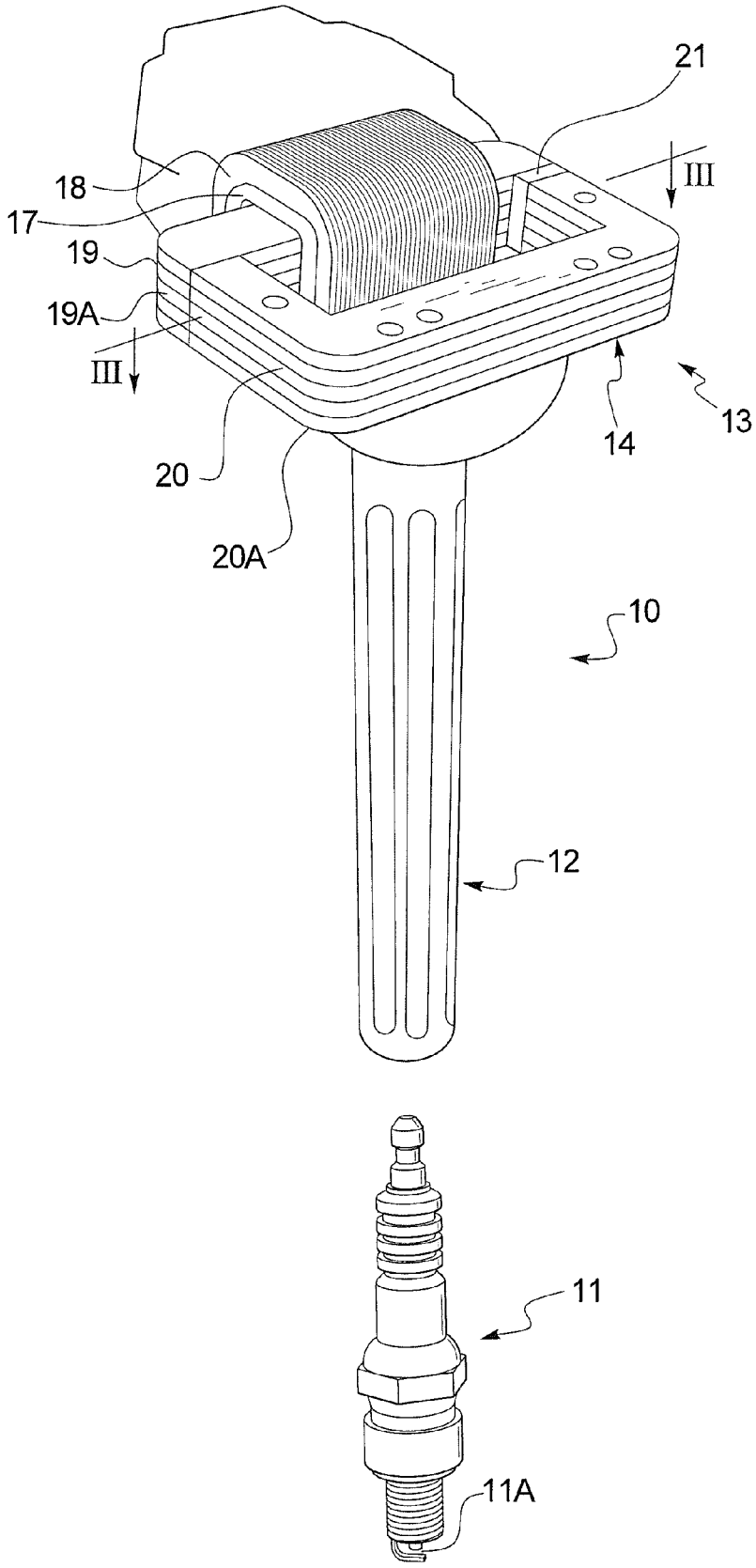
FIG. 2 (PRIOR ART)
FIG. 2 is a perspective view of the assembly of FIG. 1 with a portion of the outer cover removed showing a primary coil and secondary coil wound on a core.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included.

Figure 3:
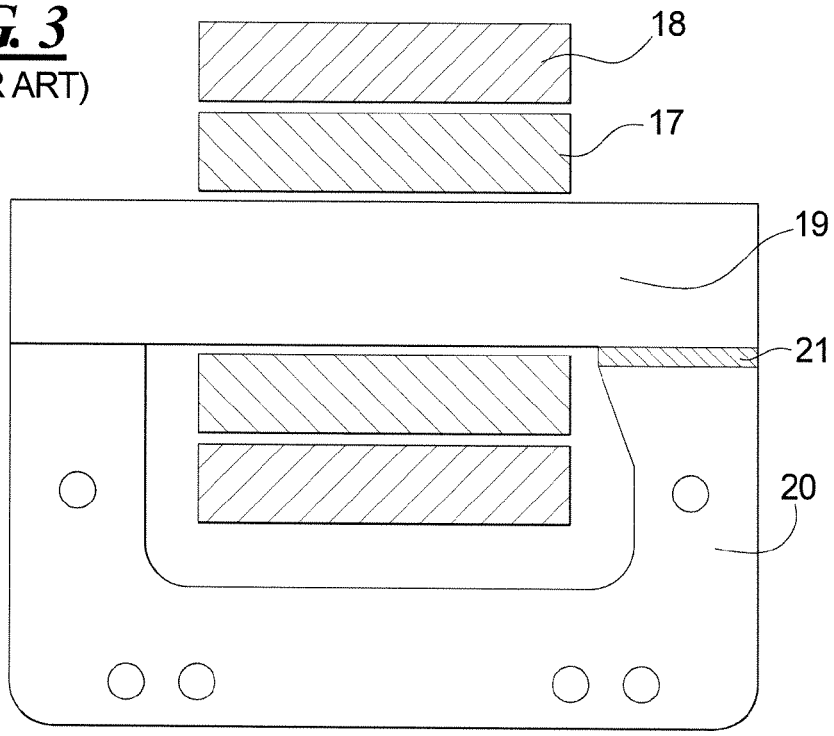
FIG. 3 (PRIOR ART)
FIG. 3 is a sectional view taken along section line III-III of FIG. 2 showing prior art use of a magnet between an I core portion and a C core portion of the core.
Figure 5:
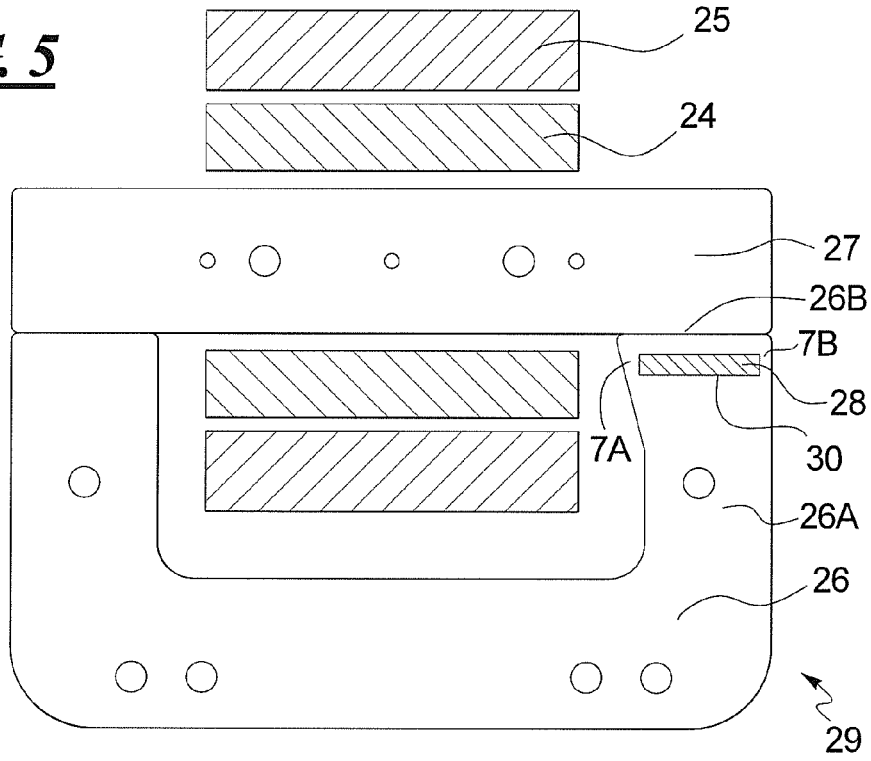
FIG. 5 is a cross sectional view of the first preferred embodiment of a core having a magnet embedded in a C core portion of the core.

FIG. 5 illustrates a first preferred exemplary embodiment in cross section similar to the cross section shown in FIG. 3. The C core portion 26 and I core portion 27 form the overall core 29. A primary coil 24 and an outer secondary coil 25 are wound to surround the I core portion 27. A magnet 28 is inserted in a through slot 30 in leg 26A of the C core portion 26 adjacent to but spaced from an end face 26B of the C core portion.

The magnet has a length which is at least 85%, preferably about 90%, and no greater than 95%, of a width of the leg at the slot. The 85% lower limit is chosen such that a neck region 7A, 7B at opposite ends of the magnet 28 is magnetically saturated to allow the MMF (Magneto-Motive Force) from the permanent magnet to travel the length of a magnetic path length. The necessity for the neck area to be saturated allows for a unidirectional flow of magnetic flux in one direction. Thus the function of the previously described magnet in the ignition coil is to act as a choke or filter so as to restrict the pulse of energy within the primary coil prior to rapid discharge through the secondary coil. The upper limit of 95% is chosen such that the lamination material at the opposite ends of the magnet 28 does not become too thin resulting in breakage and stamping problems.

The magnet has a width determined by a Magnetic Maximum Energy Product called $MGO_e$. The higher the $MGO_e$ the thinner the width of the magnet can become. The magnet width is approximately in a range between ¼ to ⅕ the length of the magnet, but it is dependent on the magnet characteristics for maximum energy product and demagnetizing effect.

The material for the laminations is preferably electrical grade steel which may or may not have a silicon content in its chemistry.

The material for the magnet is preferably sintered based iron with other elements molded into the preferred rectangular shape. For example, the magnet may be specifically formed of, in one example, neodymium iron boron. In another example the material may in particular be iron based sintered ceramic.

The slot and magnet shown are rectangular but other shapes may be employed.

Although only one magnet is shown in this first preferred embodiment, one or more permanent magnets may be embedded within the C core lamination stack at different locations. Thus various other geometric shapes and placement locations for the magnet or magnets may be provided in order to optimize a function of the ignition coil. Additional possible preferred embodiments are shown hereafter although many other possible configurations are within the scope of the exemplary embodiments in this invention.

Although use for an automobile ignition system is described herein, the preferred embodiments may be employed in any type of vehicle or boat engine, or engines used in other applications.

It may be further noted that in the first embodiment in FIG. 5 the leg 26A progressively widens as it approaches the end face 26B with the slot 30, and the magnet 28 is located at this widened portion.

Figure 6:
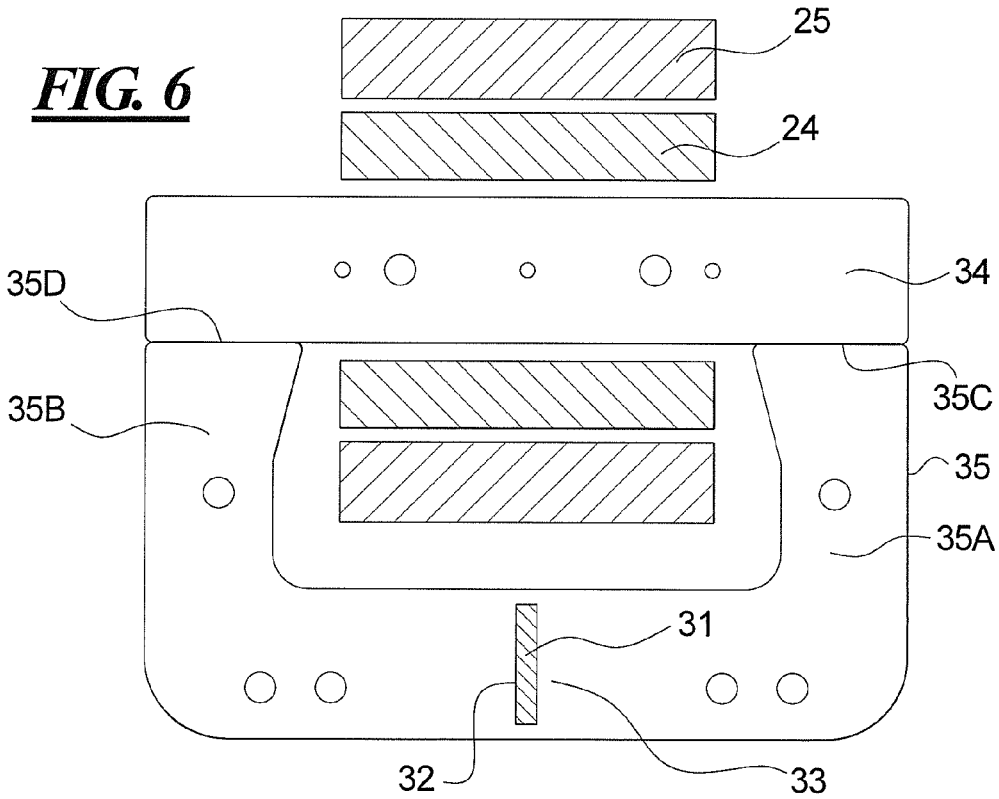
FIG. 6 is a cross sectional view of a second preferred embodiment having a magnet inserted in a C core portion of the core.

FIG. 6 shows a second preferred exemplary embodiment in an I core portion 34 and a C core portion 35 wherein the C core portion has progressively widening mirror image legs 35A and 35B approaching the end faces 35C, 35D. A magnet 31 is located in a through slot 32 in a central region 33 of an intermediate part of the core portion 35 substantially halfway between the legs 35A and 35B.

The length and width of the magnet in the intermediate part are similar to the length and width previously described for the magnet when the magnet is in a leg of the core portion.

Figure 7:
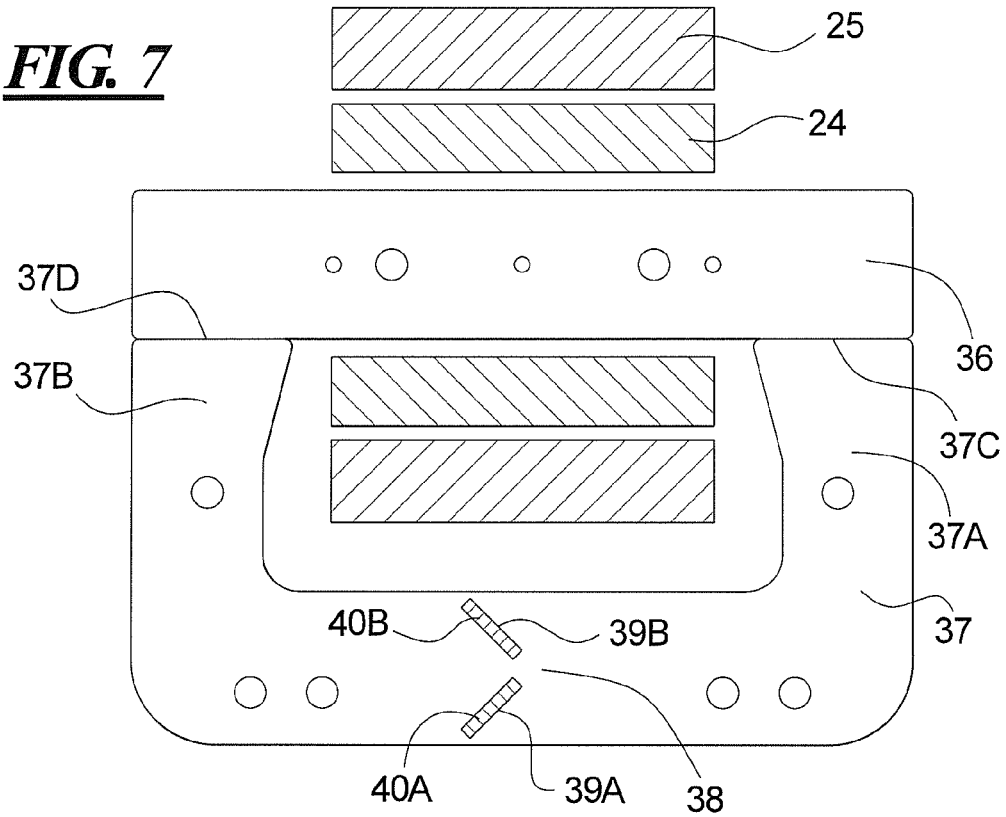
FIG. 7 is a cross sectional view of a third preferred embodiment having two magnets inserted into a C core portion of the core.

In a third preferred exemplary embodiment shown in FIG. 7 an I core portion 36 and a C core portion 37 are provided wherein the C core portion 37 has progressively widening mirror image legs 37A and 37B as they approach end faces 37C, 37D. In a central region 38 in an intermediate part approximately half way between the legs 37A, 37B first and second magnets 39A and 39B are provided in respective through slots 40A and 40B forming a V configuration with the apex of the V being substantially halfway between the legs and legs of the V being slanted such that the opening end of the V points toward the leg 37B. The magnets 39A and 39B are aligned mirror symmetrically about a longitudinal center line passing through the central portion 38 between the legs.

In the second preferred embodiment of FIG. 6 a higher flux linkage is obtained compared to the first embodiment of FIG. 5. And in the third embodiment of FIG. 7 a higher flux linkage is obtained compared to the second embodiment of FIG. 6. This supports the relationship that the secondary voltage equals the number of turns times the change in flux linkage over the change in time. This also helps the primary coil achieve the proper inductance.

Figure 8:
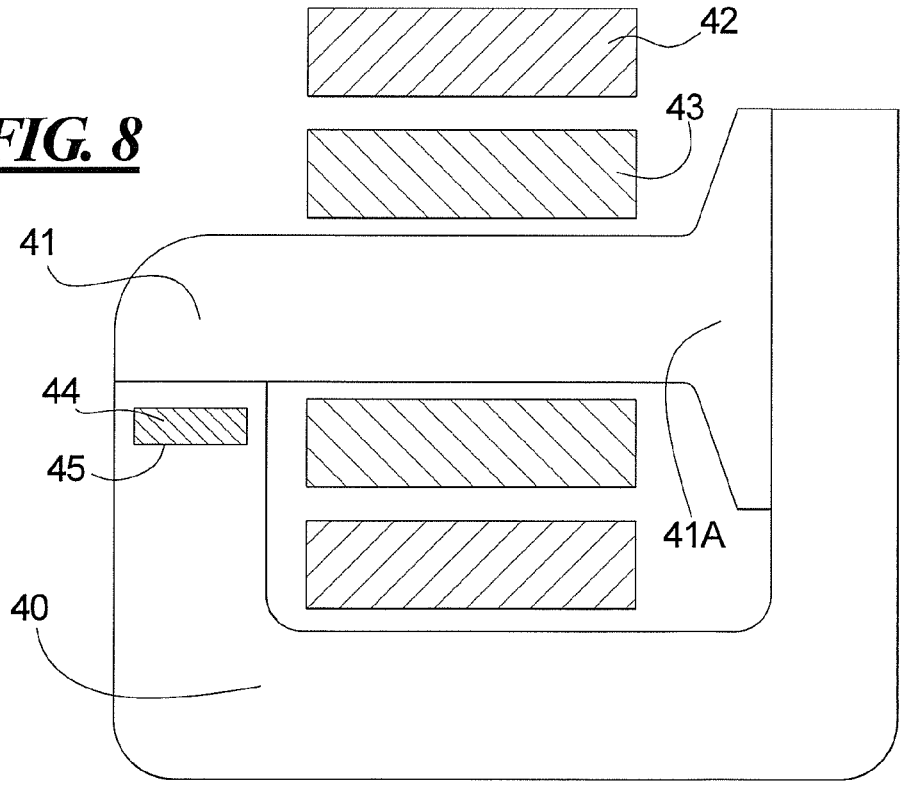
FIG. 8 is a cross sectional view of a fourth preferred embodiment in which a magnet is inserted in a C core portion in a core also having a T core portion.

In a fourth embodiment as illustrated in FIG. 8, the core is formed of a T core portion 41 and C core portion 40 with a shorter leg and a longer leg. A T part 41A of the T portion 41 abuts against a side of the longer leg of the C core portion 40. An end face of the shorter leg of the C core portion 40 abuts against a portion of the side face at an end of the T core portion 41 opposite the T part 41A. Adjacent this abutment a magnet 44 is located in a through slot 45 in the shorter leg.

Although C and I and C and T portion cores have been shown, other types of cores may be employed to create other embodiments.

Figure 4:
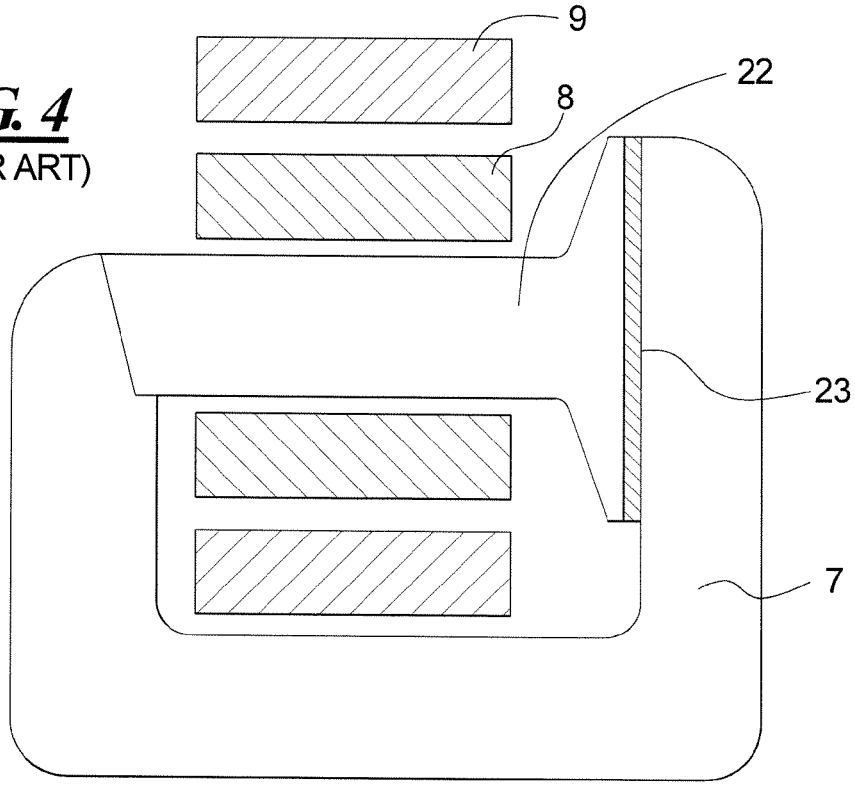
FIG. 4 (PRIOR ART)
FIG. 4 is a sectional view showing an alternate prior art core employing a C core portion and a T core portion and having a magnet between the C core portion and the T core portion.
Figure 9:
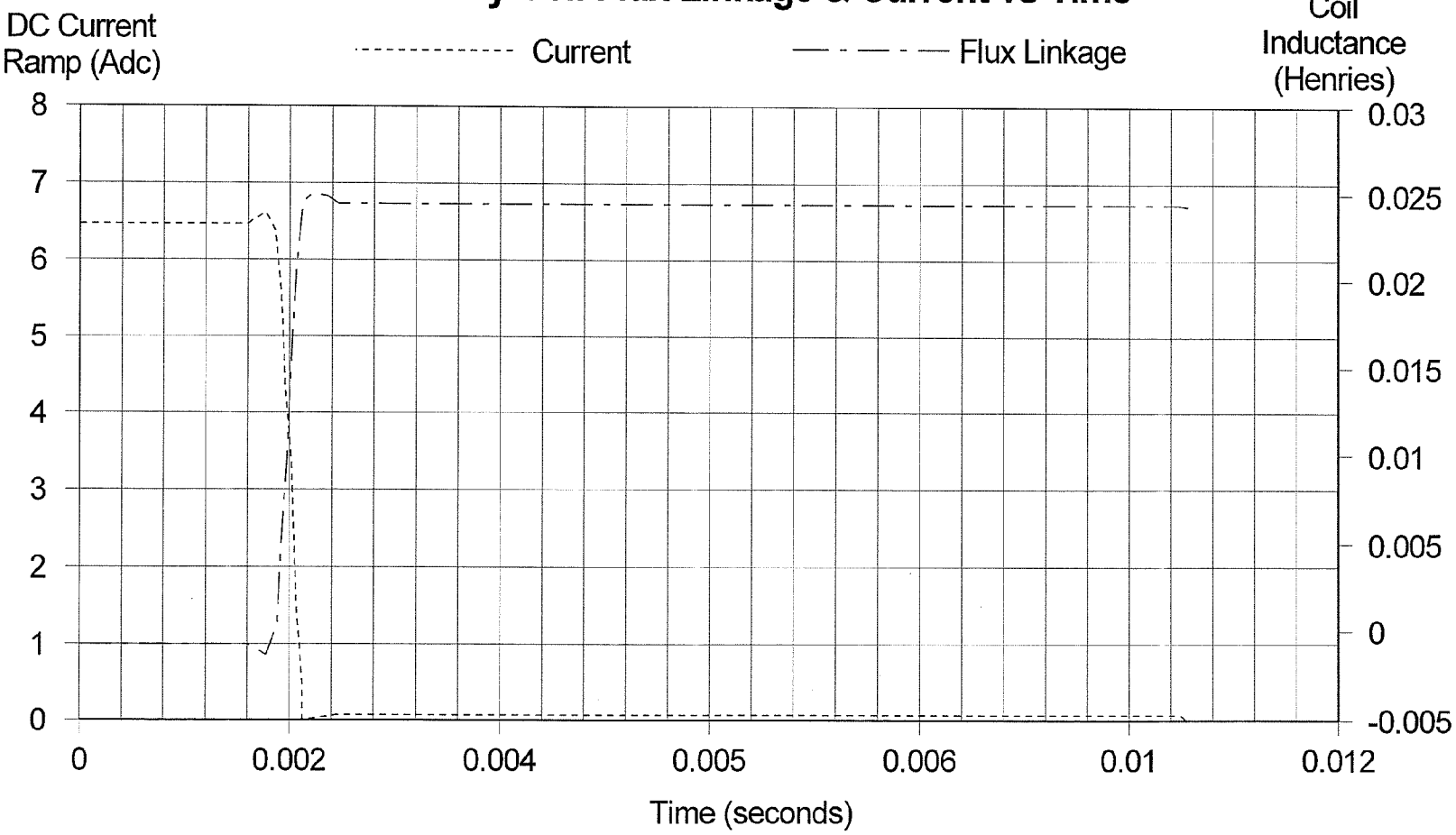
FIG. 9 (PRIOR ART)
FIG. 9 is a graph showing primary coil flux linkage and current versus time in the prior art configuration having a magnet between the I core portion and the C core portion.
Figure 10:
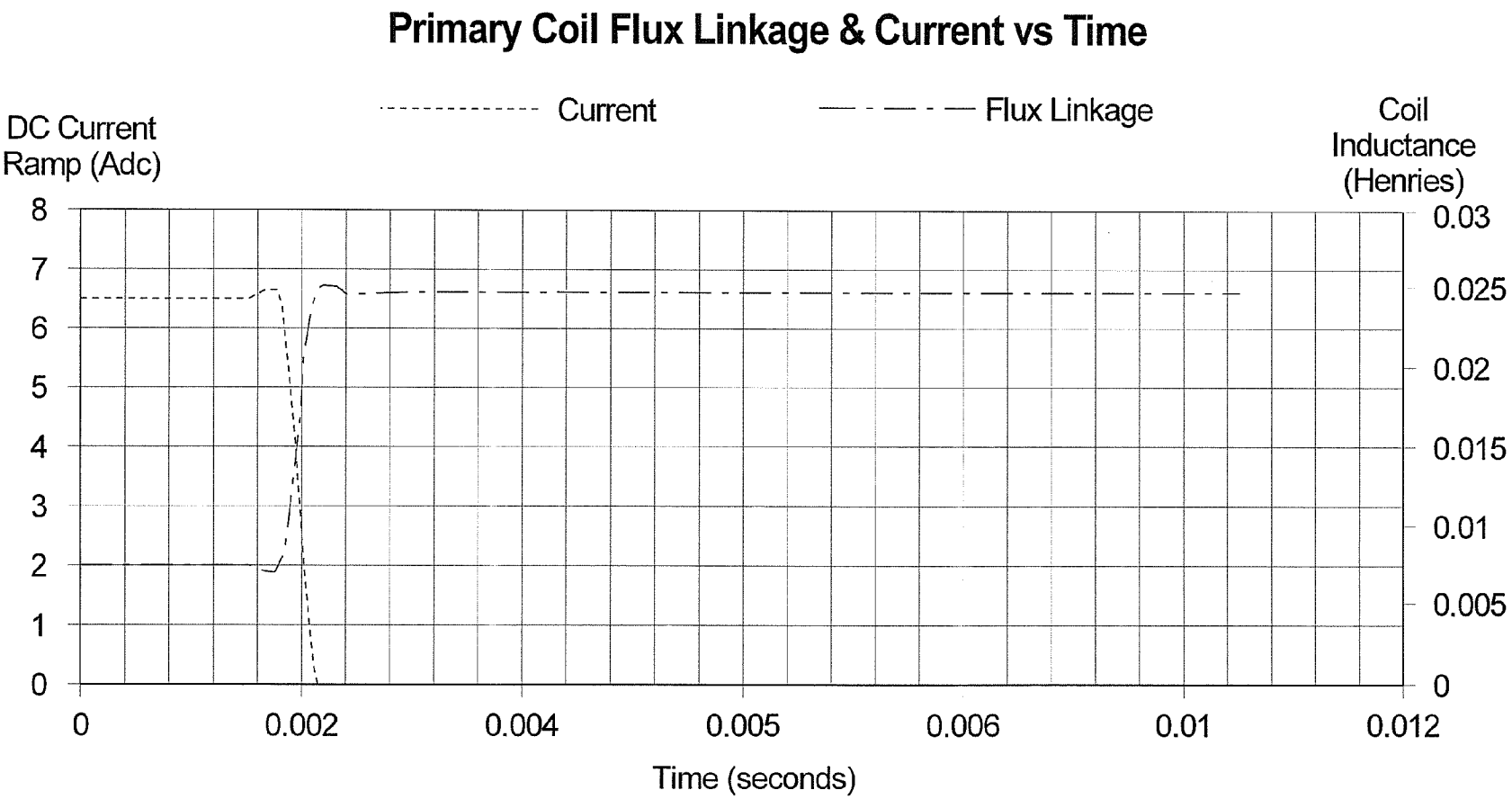
FIG. 10 is a graph showing primary coil flux linkage and current versus time for the third preferred embodiment of the core with two magnets in a V shape.

FIG. 9 is a graph showing primary coil flux linkage and current versus time for the prior art core shown in FIG. 4. FIG. 10 shows the primary coil flux linkage and current versus time for the third preferred embodiment with mirrored legs and magnets aligned in a V shape as shown in FIG. 7. Thus the graphs of FIGS. 9 and 10 depict simulations of the original prior art design versus the third preferred embodiment. The FIG. 9 graph for the prior art core shows a low flux linkage of zero Henries of inductance when the switch is closed. The FIG. 10 graph of the third preferred embodiment illustrates a flux linkage of 7.5 millihenries of inductance when the switch is closed. This difference is due to the magnetic flux or Magneto-Motive Force (MMF) emanating from the permanent magnets. This flux then travels within the magnetic circuit known as the steel laminations and couples with the copper windings of the primary coil. This MMF is in opposition to the Electro-Motive Force (EMF) emanating from the energized primary coil. The result is impedance across the primary coil which yields higher inductance. This can be described as a "choke" effect. This is necessary to have no leakage prior to the switch opening.

With the various exemplary embodiments shown, there are the following benefits:

(1) the quality, energy transfer, and duration of the spark is enhanced;

(2) the embedded magnet or magnets will allow for a smaller size of ignition coil because they create a minor restriction to the flux flow and do not cut off the flux as in the sandwich-type design of the prior art with the magnet located in the air gap between one of the legs of the C core portion and a side at one end of the I core portion;

(3) having the additional flux source close to the primary coil can reduce the turn count and allow for a larger wire (lower cost); and (4) provision of the magnet or magnets embedded as illustrated has the effect of lowering the primary coil inductance such that the total ignition coil will work with a lower energy input, as well as reducing the magnetic path length. In short, the size (and cost) of the ignition coil is reduced since it will operate more efficiently.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A spark plug ignition assembly for a spark plug, comprising:

an ignition coil assembly comprising a steel laminated core, said core having a first core portion and a second core portion, and a primary winding around the first core portion and a secondary winding around the primary winding;

a spark plug connecting member for connecting the coil assembly to the spark plug;

at least one of the first and the second core portions having a slot therein with a magnet located in the slot;

the first core portion comprising an I-shaped core portion having said primary and secondary windings around it, the second core portion comprising a C-shaped core portion, said C-shaped core portion having first and second legs and an intermediate part connecting and between the first and second legs, end faces of the first and second legs abutting against a side of the I-shaped core portion, and said slot with said magnet being located in the C-shaped core portion; and the C-shaped core portion two legs being widened in a region adjacent said respective end faces and symmetric to one another and said slot with said magnet is located in said intermediate part between the first and second legs and its longitudinal extent running substantially perpendicular to a longitudinal extent of said intermediate part and is centrally located in said intermediate part.

2. The assembly of claim 1 wherein the slot is rectangular and extends completely through the core portion, and the magnet being rectangular and substantially completely filling the slot so that the magnet extends from one face to an opposite face of the core portion.

3. The assembly of claim 2 wherein the magnet has a length which is at least 85% and no greater than 95% of a width of the intermediate part at the slot.

4. The assembly of claim 2 wherein the magnet has a width which is approximately ¼ to ⅕ a length of the magnet.

5. The assembly of claim 1 wherein the magnet comprises a sintered based iron with other elements molded into a rectangular shape of the magnet.

6. The assembly of claim 1 wherein the magnet being dimensioned and placed in said core portion at said central location such that it acts as a choke or filter so as to restrict a pulse of energy within the primary winding prior to rapid discharge through the secondary winding.

7. A spark plug ignition assembly for a spark plug, comprising:

an ignition coil assembly comprising a steel laminated core, said core having a first I-shaped core portion and a second C-shaped core portion, a primary winding around said I-shaped core portion and a secondary winding around the primary winding;

a spark plug connecting member for connecting the coil assembly to the spark plug;

the C-shaped core portion having first and second legs and an intermediate part connecting and between the first and second legs;

end faces of the first and second legs directly abutting against a side of the I-shaped core portion; and the C-shaped core portion having an opening therein comprising a rectangle at a central location thereof with a magnet located in the opening, said opening having a longitudinal extent running substantially perpendicular to a longitudinal extent of said intermediate part.

8. The assembly of claim 7 wherein the opening comprises a through slot.

9. A spark plug ignition coil assembly core for receiving a primary winding and a secondary winding, comprising:

a first I-shaped steel laminated core portion and a second C-shaped steel laminated core portion;

the second core portion having first and second legs and an intermediate part connecting and between the first and second legs;

ends of the first and second legs adjacent the first core portion; and a slot with a magnet located in said intermediate part between the first and second legs, said slot being rectangular, and having a longitudinal extent running substantially perpendicular to a longitudinal extent of said intermediate part.

* * * * *